United States Patent [19]

Sabol et al.

[11] Patent Number: 4,690,716

[45] Date of Patent: Sep. 1, 1987

[54] PROCESS FOR FORMING SEAMLESS TUBING OF ZIRCONIUM OR TITANIUM ALLOYS FROM WELDED PRECURSORS

[75] Inventors: George P. Sabol, Murrysville Boro; Robert F. Barry, Monroeville, both of Pa.

[73] Assignee: Westinghouse Electric Corp., Pittsburgh, Pa.

[21] Appl. No.: 701,326

[22] Filed: Feb. 13, 1985

[51] Int. Cl.[4] ..... C21D 8/10

[52] U.S. Cl. ..... 148/11.5 F; 148/11.5 Q; 148/127

[58] Field of Search ..... 148/11.5 F, 11.5 Q, 148/127; 420/422; 266/104

[56] References Cited

U.S. PATENT DOCUMENTS

| | | | |
|---|---|---|---|
| 1,252,144 | 1/1918 | Murray, Jr. et al. | 148/127 |
| 2,057,841 | 10/1936 | Newhouse | 148/127 |
| 2,133,926 | 10/1938 | Ransom, Jr. et al. | 148/127 |
| 3,147,115 | 9/1964 | Vordahl | 148/127 |
| 3,272,954 | 9/1966 | Seulen et al. | 148/154 |
| 3,342,648 | 9/1967 | Zucker et al. | 148/11.5 F |
| 3,486,219 | 12/1969 | Davies et al. | 148/11.5 F X |
| 3,556,877 | 1/1971 | Ujiie | 148/127 |
| 3,562,031 | 2/1971 | Gibson | 148/154 |
| 3,686,041 | 8/1972 | Lee | 148/11.5 F |
| 3,795,970 | 3/1974 | Keathley et al. | 148/11.5 F |
| 3,865,635 | 2/1975 | Hofvenstam et al. | 148/11.5 F |
| 3,915,763 | 10/1975 | Jennings et al. | 148/127 |
| 4,142,713 | 3/1979 | Nakasugi et al. | 148/127 |
| 4,238,251 | 12/1980 | Williams et al. | 148/421 X |
| 4,279,667 | 7/1981 | Anthony et al. | 148/421 |
| 4,294,631 | 10/1981 | Anthony et al. | 148/133 |
| 4,365,136 | 12/1982 | Gottlieb | 148/127 X |
| 4,450,016 | 5/1984 | Vesterlund et al. | 148/11.5 F |
| 4,450,020 | 5/1984 | Vesterlund | 148/11.5 F |

FOREIGN PATENT DOCUMENTS

| | | |
|---|---|---|
| EP0071193 | 2/1983 | European Pat. Off. . |
| EP0085552 | 8/1983 | European Pat. Off. . |
| EP0085553 | 8/1983 | European Pat. Off. . |
| 2368547 | 10/1977 | France . |

OTHER PUBLICATIONS

Metals Abstracts, vol. 7, Jun. 1974, No. 55-0516, "The Heat Treatment of VT3-1 (Titanium) Alloy Welds".

Greenfield et al, "Thermomechanical Processing of a Welded Metastable Beta Titanium Alloy", Welding Journal, Aug. 1974, pp. 339s-342s.

Translation of: "The Heat Treatment of Welded Joints in VT3-1 Alloy" by Zagrebenyuk et al., in Avt. Svarka, 1973, No. 8, pp. 69-70 (Translation pp. 64, 65).

*Primary Examiner*—Christopher W. Brody

[57] ABSTRACT

Seamless tubing is formed from welded precursors of zirconium or titanium material by heating successive axial segments of welded tubing completely through the wall of the tubing to convert the material to the beta phase and then rapidly quenching the segments, with the heating and quenching effected so as to prevent the growth of beta grains within the material.

15 Claims, No Drawings

PROCESS FOR FORMING SEAMLESS TUBING OF ZIRCONIUM OR TITANIUM ALLOYS FROM WELDED PRECURSORS

CROSS-REFERENCE TO RELATED APPLICATION

A process for improving the high temperature aqueous environment corrosion resistance of an alpha zirconium alloy body is described in related application Ser. No. 571,123, filed Jan. 13, 1984 as a continuation of abandoned Ser. No. 343,788, filed Jan. 29, 1982, assigned to the assignee of the present invention. In that process, the surface of a zirconium alloy body is rapidly scanned with a laser beam, or other high energy beam to provide a layer of beta treated microstructure on an alpha zirconium alloy intermediate product. The treated product is then alpha worked to a final size to produce articles, such as seamless tubing, suitable for use in pressurized water and boiling water nuclear reactors. Said application is incorporated by reference herein.

Zircaloy alloy fabrication methods and resultant products which also exhibit improved high temperature, high pressure aqueous environment corrosion resistance are described in related application Ser. No. 571,122, filed Jan. 13, 1984 now U.S. Pat. No. 4,584,030 as a continuation of abandoned Ser. No. 343,782 filed Jan. 29, 1982, assigned to the assignee of the present invention. This related application describes a process in which a conventional beta treatment is followed by reduced temperature alpha working and annealing to provide an alpha worked product having reduced precipitate size, as well as enhanced high temperature, high pressure aqueous environment corrosion resistance, and is incorporated by reference in application Ser. No. 343,788, and herein.

BACKGROUND OF THE INVENTION

The present invention relates to a process for forming seamless articles, such as tubing or zirconium or titanium material, from precursors formed by welding. The process provides a product that has uniform alpha structure throughout the article, including the weld and adjacent areas of the article.

Welded articles, such as tubing, can often be produced much more economically than seamless articles. However, seamless articles such as tubing of zirconium alloys and titanium alloys are preferred over welded tubing in critical applications, such as nuclear reactor fuel cladding (for zirconium alloys) and aircraft hydraulic lines (for titanium alloys) because of the enhanced uniformity in structure and properties of the seamless product. The non-uniformity, or heterogeneity, of the structure of a welded product is caused by the presence of the as-solidified weld structure and the weld heat-affected zones in the structure adjacent the weld.

In welded articles, the grain structure of the weld and head-affected zones could be refined by treatment in the high temperature beta phase field, but treatment of finished or near-finished-size tubing of reactive metals such as zirconium or titanium at temperatures above the beta transus, i.e. above about 950° C., or 930° C. respectively, is generally impractical because of oxidation and poor strength at such temperatures.

A process for improving the creep strength of Zircaloy tubes is disclosed in U.S. Pat. No. 3,865,635. According to that process, seamless tubes of a zirconium alloy are heated, before the last cold working step to the beta range and are then cooled to room temperature. The tubes were prepared in the normal way by means of melting, casting, hot and cold working up to and including the last but one cold working step. Inductive heating of the tube prior to the final cold working step was then effected, at a temperature of between 860°-1250° C., and the tube cold worked and finally annealed. In such preparation of tubes, seamless tubing is processed and no welds are present.

A process that teaches formation of zirconium-based alloy articles, such as hollow channels, which may be formed from welded intermediate forms, and seamless fuel cladding is described in U.S. Pat. No. 4,238,251. The articles are fabricated and then heated to the alpha-beta or beta range and quickly quenched, to produce corrosion resistant products. It is emphasized, however, in that process description, to avoid processing operatives, subsequent to the aforementioned heating and quenching, such as hot or cold rolling and annealing. An effect of such cold working or annealing is stated to be re-homogenization of the microstructural segregation produced by the process of that invention, which must be avoided in subsequent fabrication operations.

A further method for forming zirconium alloy tubes is described in U.S. Pat. No. 3,486,219. In that reference, there is disclosed a method of homogenizing the structure of a tube formed by butt welding, including reducing the wall thickness of the tube material by planatary swaging and heat treating the tube material to effect recrystallization of the structure. Treatment of Zircaloy butt welded tubes is disclosed where the tube is cold worked by planetary ball swaging and the subsequent heat treatment carried out at a temperature under the alpha-beta transformation temperature of the Zircaloy.

An object of the present invention is to produce tubing from zirconium or titanium metals or alloys by the treatment of welded precursors of such material to give a homogeneous material and subjecting the homogeneous material to forming steps to give a seamless tubing.

SUMMARY OF THE INVENTION

Seamless tubing is prepared from a welded precursor tubing of zirconium or titanium material by rapidly heating the presursor tubing completely therethrough, such as by heating with a laser beam or by induction to the beta phase and rapidly cooling the same, to provide a homogeneous structure having beta grains of a size less than 200 micrometers in diameter distributed throughout the material, and subsequently deforming the material to produce a seamless tubing. The deforming of the homogeneous material is such that the area of the tubing material is reduced at least 30 percent in each working stage, and is preferably cold reduced by pilgering.

DETAILED DESCRIPTION

The present process provides a means for forming tubing, having the attributes of seamless tubing, from welded tubing that exhibits heterogeneity in the structure of the tubing in the area of the weld. By using the present process, tubing is formed by a more efficient and economical method than as present with seamless tubing, and the welded precursors can be treated so as to give a final tubing that does not suffer from the disadvantages of conventionally produced welded tubing.

The present process is usable on welded precursors of zirconium or an alloy of zirconium, containing less than about 5 percent by weight of alloying elements. The elements generally used in the formation of such zirconium alloys include niobium, oxygen, tin, iron, chromium, nickel, molybdenum, copper, vanadium and the like. Especially useful alloys are a zirconium alloy containing up to about 2.5 percent niobium, and the alloys known as Zircaloy-2 and Zircaloy-4. Zircaloy-2 contains, by weight, about 1.2–1.7 percent tin, 0.07–0.20 percent iron, 0.05–0.15 percent chromium, and about 0.03 to 0.08 percent nickel, the balance being zirconium, while Zircaloy-4 contains, by weight about 1.2–1.7 percent tin, 0.12 to 0.18 percent iron, and 0.05 to 0.15 percent chromium, the balance being zirconium. These alloys are usable in heat exchanger tubing and in nuclear reactor components, such as cladding.

The present process is also usable on welded precursors of titanium or an alloy of titanium containing less than about 30 percent by weight of alloying elements. The elements generally used in the formation of such titaniuim alloys include aluminum, tin, vanadium, chromium, molybdenum, niobium and the like. Examples of such alloys are an alloy of titanium containing 6 percent by weight aluminum and 4 percent by weight vanadium; an alloy containing 3 percent aluminum and 2.5 percent vanadium; an alloy containing 8 percent aluminum, 1 percent vanadium, and 1 percent molybdenum; and an alloy of titanium containing 13 percent vanadium, 11 percent chromium, and 3 percent aluminum. Such titanium alloys are useful in condenser tubing, heat exchange tubing, and in aircraft hydraulic tubing.

For the purpose of brevity, the following description will refer to Zircaloy tubing, although zirconium or other zirconium alloy, titanium, and titanium alloy tubing would be similarly processed.

The material subjected to the present process is a welded Zircaloy tubing that has been formed by welding the confronting ends of a rolled sheet together to form a precursor tubing. The tubing may be cylindrical or in other shape which has at least one welded seam along the length of the precursor tubing. As is known, in the formation of such welded tubing, heterogeneity of the structure of the Zircaloy material exists in the weld and in at least the areas of the tubing adjacent the weld, relative to the remainder of the tubing, which heterogeneity is detrimental to mechanical properties and/or corrosion resistance. The present process treats the material in such a way as to produce a homogeneous structure completely throughout the final tubing that will improve the properties of the tubing produced.

The welded Zircaloy tubing precursor is treated to produce a homogeneous structure throughout the tubing by rapidly heating successive axial segments of the welded tubing completely through the wall thereof to transfer the material into the beta phase, rapidly cooling the beta phase tubing, and then subsequently deforming the quenched tubing, by cold working, to produce a final tube. The precursor welded tubing is treated by rapidly heating successive axial segments of the tubing to a temperature that effects transformation of the structure of the tubing into the beta phase, which for zirconium would be to a temperature in excess of about 900° C., while for alloys of zirconium containing up to about 5 percent of the aforementioned elements, such temperatures could be as high as 950° C. or higher, depending upon the alloying element or elements and the amount of such elements in the zirconium. For titanium and titanium alloys, the beta phase transus would vary, with a temperature of about 930° C. suitable for titanium. For example, a temperature of about 900° C. would be suitable for a 6 percent aluminum, 4 percent vanadium alloy; a temperature of between about 800°–1000° C. for a 13 percent vanadium, 11 percent chromium and 3 percent aluminum alloy; and a temperature of about 1025° C. for an 8 percent aluminum, 1 percent molybdenum and 1 percent vanadium alloy. The present process is usable with metals and alloys of alpha phases, beta phase and alpha-beta phase structure. For example, in the materials above listed, titanium metal would exhibit an alpha structure; while the 13 percent vanadium, 11 percent chromium and 3 percent aluminum alloy of titanium would exhibit a beta structure; and the 8 percent aluminum, 1 percent molybdenum, 1 percent vanadium, titanium alloy, and 6 percent aluminum, 4 percent vanadium, titanium alloy, and the 3 percent aluminum, 2.5 percent vanadium, titanium alloy would exhibit an alpha-beta or near alpha structure. Preferably, the material is heated to a temperature of about 50° C. higher than the beta transus temperature, which. as described above, will vary dependent upon the particular material being treated.

The rapid heating of successive axial segments can be effected either by use of a high energy beam, such as a laser beam, or by induction heating of the tubing. The heating is effected such that the tubing is heated completely through the wall of the tubing, including the weld and the tubing adjacent the weld. The heating of successive axial segments of the tubing may be carried out by moving the tubing past the heat source, or moving the heat source relative to the tubing, with the former being preferred.

After the axial segments of the tube are heated, completely through the wall of the tube, into the beta phase, the heated axial segments are rapidly cooled, so as to prevent excessive growth of beta grains in the structure of the material. The rapid cooling may be effected by a passage of coolant gas, such as argon, for thin walled tubing or by water quenching, such as by a spray of water for thicker walled tubing. An average rate of cooling of about 600° C. per minute has been found suitable.

The heating and cooling are carried out at a rate that will prevent excess growth of beta grains in the material, such that the beta grains present in the quenched precursor are less than 200 micrometers in diameter, which small beta grain size enables workability of the material. In order to achieve such fine sized beta grain structure, the heating and cooling must be effected such that the material is in the beta phase for a period of time of less than 10 seconds, and preferably less than about 2 seconds.

After the precursor tubing has been heated and quenched, so as to give beta grains completely throughout the material of less than about 200 micrometers in diameter, the precursor tubing is then subjected to cold reduction steps to reduce the wall thickness to that desired for the final tubing. The cold working may be effected in a single stage or in a plurality of stages with intermediate recrystallization anneals between each of the plurality of stages. The final sized material can then be subjected to either a recrystallization or stress relief anneal.

The cold working may be effected by drawing of the tube or a cold working step, such as pilgering, which will reduce the area of the tubing at least 30 percent or more. The fine Widmanstatten or martensitic structure resulting from the rapid heat treatment cycle possess sufficient ductility to allow appreciable cold deformation consistent with commerical tube manufacture.

What is claimed is:

1. A process for forming seamless tubing of a material selected from zirconium, zirconium alloys, titanium, and titanium alloys, from welded precursor tubing of said material, having a heterogeneous structure resulting from the welding thereof, comprising:

heating succesive axial segments of the welded tubing, completely through the wall thereof, including the weld, to uniformly transform the heterogeneous, as welded, material into the beta phase;

quenching said beta phase tubing segments, said heating and quenching effected sufficiently rapid enough to produce a fine sized beta grain structure completely throughout the precursor tubing, including the weld, and to prevent growth of beta grains within the material larger than 200 micrometers in diameter; and subsequently substantially uniformly deforming said quenched precursor tubing by cold reduction steps to produce a seamless tubing of final size and shape.

2. The process as defined in claim 1 wherein said quenched tubing is deformed by cold working the same in at least one cold working stage, which cold working stage reduces the area of the tubing material at least 30 percent.

3. The process as defined in claim 1 wherein said cold working is by pilgering.

4. The process as defined in claim 2 wherein said heating is effected by induction heating of said welded tubing.

5. The process as defined in claim 2 wherein said heating is effected by laser beam heating of said welded tubing.

6. The process as defined in claim 1 wherein the material of said welded precursor tubing is a zirconium material selected from the group consisting of zirconium and an alloy of zirconium containing less than about 5 percent by weight of an alloying element.

7. The process as defined in claim 6 wherein said material is Zircaloy-2.

8. The process as defined in claim 6 wherein said material is Zircaloy-4.

9. The process as defined in claim 6 wherein said material is a zirconium alloy containing 2.5 percent by weight niobium.

10. The process as defined in claim 1 wherein the material of said welded precursor tubing is a titanium material selected from the group consisting of titanium and a titanium alloy containing less than about 30 percent of alloying elements.

11. The process as defined in claim 10 wherein said material is a titanium alloy containing 6 percent by weight aluminum and 4 percent by weight vanadium.

12. The process as defined in claim 10 wherein said material is a titanium alloy containing 3 percent by weight aluminum and 2.5 percent by weight vanadium.

13. The process as defined in claim 10 wherein said material is a titanium alloy containing 8 percent by weight aluminum, 1 percent by weight vanadium and 1 percent by weight molybdenum.

14. The process as defined in claim 10 wherein said material is a titanium alloy containing 13 percent by weight vanadium, 11 percent by weight chromium and 3 percent by weight aluminum.

15. A process for forming seamless tubing of a material selected from zirconium, zirconium alloys, titanium, and titanium alloys, comprising: welding the confronting ends of a rolled sheet of said material together to form a welded precursor tubing of said material, having a heterogeneous structure resulting from the welding thereof;

heating successive axial segments of the welded tubing, completely through the wall thereof, including the weld, to uniformly transform the heterogeneous, as welded, material into the beta phase;

quenching said beta phase tubing segments, said heating and quenching effected sufficiently rapid enough to produce a fine sized beta grain structure completely throughout said tubing segments, including the weld, and to prevent growth of beta grains within the material larger than 200 micrometers in diameter; and subsequently substantially uniformly deforming said quenched precursor tubing by cold reduction steps to produce a seamless tubing of final size and shape.

* * * * *